US005941033A

United States Patent [19]

Adams

[11] Patent Number: 5,941,033

[45] Date of Patent: Aug. 24, 1999

[54] WINDOW TRIM ASSEMBLY

[76] Inventor: Carl W. Adams, 4500 Collister Dr. P.O. Box 3295, Boise, Id. 83703

[21] Appl. No.: 08/912,594

[22] Filed: Aug. 18, 1997

[51] Int. Cl.[6] ..... E06B 1/30

[52] U.S. Cl. ..... 52/212; 52/217; 52/211

[58] Field of Search ..... 52/211, 212, 204.53, 52/204.54, 217, 213, 204.591, 204.597, 204.67; 49/504, 505

[56] References Cited

U.S. PATENT DOCUMENTS

| | | | |
|---|---|---|---|
| 3,203,053 | 8/1965 | Lane et al. | 20/56.5 |
| 3,401,487 | 9/1968 | Brandt et al. | 49/504 |
| 3,545,135 | 12/1970 | Lieber | 49/505 |
| 3,757,473 | 9/1973 | Mundy | 52/212 X |
| 3,788,019 | 1/1974 | Kiselewski | 52/212 |
| 3,800,488 | 4/1974 | Swanson | 52/212 |
| 4,387,542 | 6/1983 | Wehr | 52/209 |
| 4,463,530 | 8/1984 | Albert | 52/171.1 |
| 4,525,966 | 7/1985 | Litchfield | 52/397 |
| 4,787,184 | 11/1988 | Boidron | 52/217 |
| 4,809,469 | 3/1989 | Klein | 52/32 |
| 4,912,879 | 4/1990 | Mozuras | 52/217 X |
| 5,095,676 | 3/1992 | Muhle | 52/476 |
| 5,203,130 | 4/1993 | Freelove | 52/211 |
| 5,339,583 | 8/1994 | Hrdlicka | 52/204.53 |
| 5,392,574 | 2/1995 | Sayers | 52/217 |
| 5,575,123 | 11/1996 | Adams | 52/212 |
| 5,596,851 | 1/1997 | Ting | 52/211 |

*Primary Examiner*—Beth Aubrey
*Attorney, Agent, or Firm*—Robert L. Shaver; Frank J. Dykas

[57] ABSTRACT

A vinyl window finish trim assembly is provided which attaches to an extruded window frame mounted in a window opening. The window finish trim assembly is cut to fit on site or in the factory, and snaps into attachment with the window frame mounted in the window opening. The window finish trim assembly is adjustable for variations in the thicknesses of walls and window frames, and when finished has the appearance of painted wood window trim. It offers a design by which all of the pieces of the window trim are cut from either one, two or three types of extruded stock. Corner pieces are also utilized for ornamentation and structural strength.

10 Claims, 6 Drawing Sheets

WINDOW TRIM ASSEMBLY

BACKGROUND OF THE INVENTION

1. Field of the Invention

The present invention generally relates to extruded window trim devices, and more specifically to extruded window trim devices which attach to extruded aluminum or vinyl window frames and have the appearance of painted wood trim.

2. Description of Related Art

A number of devices have been patented to make the installation of windows in window openings more efficient. Many of these attempts have been particularly adapted to manufactured housing, in which efficiency of production is paramount, and appearance is somewhat less important. Inventions in this field almost invariably are extruded window frames with grooves or channels into which a pane of glass is mounted. The window mounting device of this type of invention is typically of extruded vinyl or aluminum, and assembles together on either side of the wall adjacent to the window opening in the wall. Some of these devices have parts that snap together, slide together, or are screwed together. Some examples of this type of prior art includes Lane, U.S. Pat. No. 3,203,053, Sayers, U.S. Pat. No. 5,392,574, and Boidron, U.S. Pat. No. 4,787,184. Each of these patents have multiple pieces which snap together and surround the wall opening where a window frame is to be formed. Each of them have channels or grooves into which a pane of glass is placed, thereby forming a window. Each of these is also of extruded aluminum, metal, or other extrudable material.

A disadvantage of prior art of this type is that the resulting window has the appearance of being made from some material other than wood. For this reason, these kinds of devices are limited in application to manufactured homes. They have not found success in site built homes because the traditional appearance of windows and their accompanying finish trim has been a desirable feature for the owners and builders of site built homes.

Another disadvantage with the prior art systems of trimming a window is that nails and screws used are usually visible after installation, or they must be covered in some way, such as by countersinking and plugging, or by painting over, spackling or covering in some way.

Additionally, the use of window frames made of extruded vinyl pieces has become universally standard among builders. These frames can be of extruded aluminum, vinyl, vinyl with wood pieces, or other extrudable materials. These extruded window frames typically come with a groove called a mulling groove along the edges which can be used by builders to join one window to other windows if they are placed side by side or stacked vertically. If a single window is placed in a wall, however, this mulling groove is not utilized by the builder.

Along with the use of extruded vinyl or aluminum window frames which are nailed into a window opening in the wall, traditional techniques of trimming the inside of the window have continued. The surface inside the window opening is typically called the window casing, and after installation of the window frame, the casing may be covered with a layer of wood or sheet rock. The wood or sheet rock casing trim is made flush with the sheet rock on the interior surface of the wall. Adjacent to the window opening along the interior surface of the wall, strips of molding may be attached which abut the window opening and finish the trim of the window.

What is needed, then, is a window trim assembly which interconnects with extruded vinyl or window frames, and which replaces the trim of the inside of the window, such as the casing and the molding, with an assembly which is easy to cut to fit in a factory or at the building site, and which duplicates the appearance of a traditional site built inside window trim. Accordingly, it is an object of the invention to provide an inside window finish trim assembly which interacts with extruded vinyl or aluminum window frames.

It is a further object of the invention that this window finish trim assembly be easily cut to fit in a factory or on the site and is easily installed, in a way that is more efficient than traditional window trim treatments.

It is a further object of the invention that the window finish trim assembly have the appearance of a painted wood window trim assembly. It is a further object of the invention that the window finish trim assembly be adjustable, to account for varying thicknesses of walls, window frames and window casings.

It is a further object of the invention that the window finish trim assembly be designed for installation so that no fasteners are visible after installation, and so that any fasteners used, such as nails or screws, do not have to be hidden using such techniques as spackling, painting or covering with a plug.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are attained by a window finish trim assembly which attaches, or interfits, within an extruded vinyl or aluminum window in a framed window opening in a wall. The window finish trim assembly is assembled and inserted into the window opening so as to cover the window casing and provide the finish trim for the window installation. By window casing, what is meant is the region between the window frame and an interior wall surface adjacent the window opening.

In one aspect of the invention, the window finish trim assembly includes a casing piece which mounts to each of the four sides of a window opening. Although windows with four sides are discussed in each aspect of the invention, it is to be understood that windows with a different number of sides can also be utilized with the invention. The casing piece is generally an L-shaped piece which is made of extruded material, preferably vinyl. The extruded vinyl is made to have the dimensional and surface appearance of painted wood window trim. To achieve this appearance, the extruded casing piece has a three-dimensional cross-sectional shape, similar to the painted wood window trim it replaces, and the surface of the extruded vinyl is of a color and texture similar to that of painted wood. The casing piece is made L-shaped by the perpendicular joining of two portions, a body portion and a flange portion. The body portion engages the mulling groove of the window frame and extends from the window frame next to the inner wall of the wall opening. Next to the inner wall of the wall opening, the body portion is attached to a flange portion, which extends radially around the window opening and covers a portion of the interior wall surface adjacent the window opening. This flange portion has the same appearance and function as molding applied in traditional window trim treatments. A way for engaging the body portion of the casing piece with the extruded vinyl or aluminum window frame is provided, which would typically be a protruding ridge from the body portion, which engages a mulling groove in the extruded vinyl or aluminum window frame. It could also be engaged by gluing, the use of adhesive, or by bedding in caulk. The window finish trim assembly is also provided with a way to attach the vinyl casing piece to the interior wall surface. This would typically be by the use of an adhesive strip, or double-sided tape, a bead of adhesive, or other means of attachment.

Additionally, a corner piece is used where two casing pieces are joined together in a mitered joint. Corner pieces would typically have projections which would snap into predrilled holes in the two casing pieces, and would serve to cover the joint line between the two casing pieces and to provide structural strength to the two joined casing pieces.

In accordance with another aspect of the invention the window finish trim assembly is generally as described above, but additionally has a generally U-shaped piece which is made of extruded material, preferably vinyl, and called a channel piece. The channel piece has a protruding ridge by which it is joined to a mulling groove in the extruded window frame. It could also attach to the window frame by gluing, bedding in caulk, or by screwing, riveting, or other mechanical means. Inside the "U" portion of the U-shaped channel piece is inserted the body portion of the casing piece. The body portion of the casing piece can slide in and out of the U-trough in order to compensate for varying widths of window casings, varying wall thicknesses, and varying window frame thicknesses and placements. As described above, the body portion of the casing piece is attached to a flange portion, which attaches by adhesive strip, adhesive bead, double-sided tape, or other means to the wall. A corner piece would also be optionally used in this aspect of the invention.

A third aspect of the invention is a vinyl window finish trim assembly which includes a generally U-shaped extruded vinyl channel piece which engages the extruded window frame. It also includes a U shaped channel piece, and an L-shaped extruded vinyl casing piece which is in two portions, a body portion and a flange portion. The body portion of the extruded vinyl casing piece can slide in and out of the U-trough of the channel piece. This is to compensate for varying widths of wall, siding, and window frame. The flange portion of this aspect of the invention attaches to the wall by use of adhesives, nails or screws. The casing piece of this version forms a channel into which an extension of a molding piece can extend and snap into place.

In this version of the invention, a molding piece covers the supporting nails or screws which hold the flange piece of the casing piece and the entire unit in place. The flange piece is covered by a molding piece which snaps into place by a projection of the molding piece being inserted into a receiving groove in the casing piece.

In all three of these versions of the vinyl window finish trim assembly, the finish appearance of the device is similar to the appearance of painted wood surfaces of traditional window trim treatments, with no nails or crews being visible.

Still other objects and advantages of the present invention will become readily apparent to those skilled in this art from the following detailed description wherein I have shown and described only the preferred embodiments of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
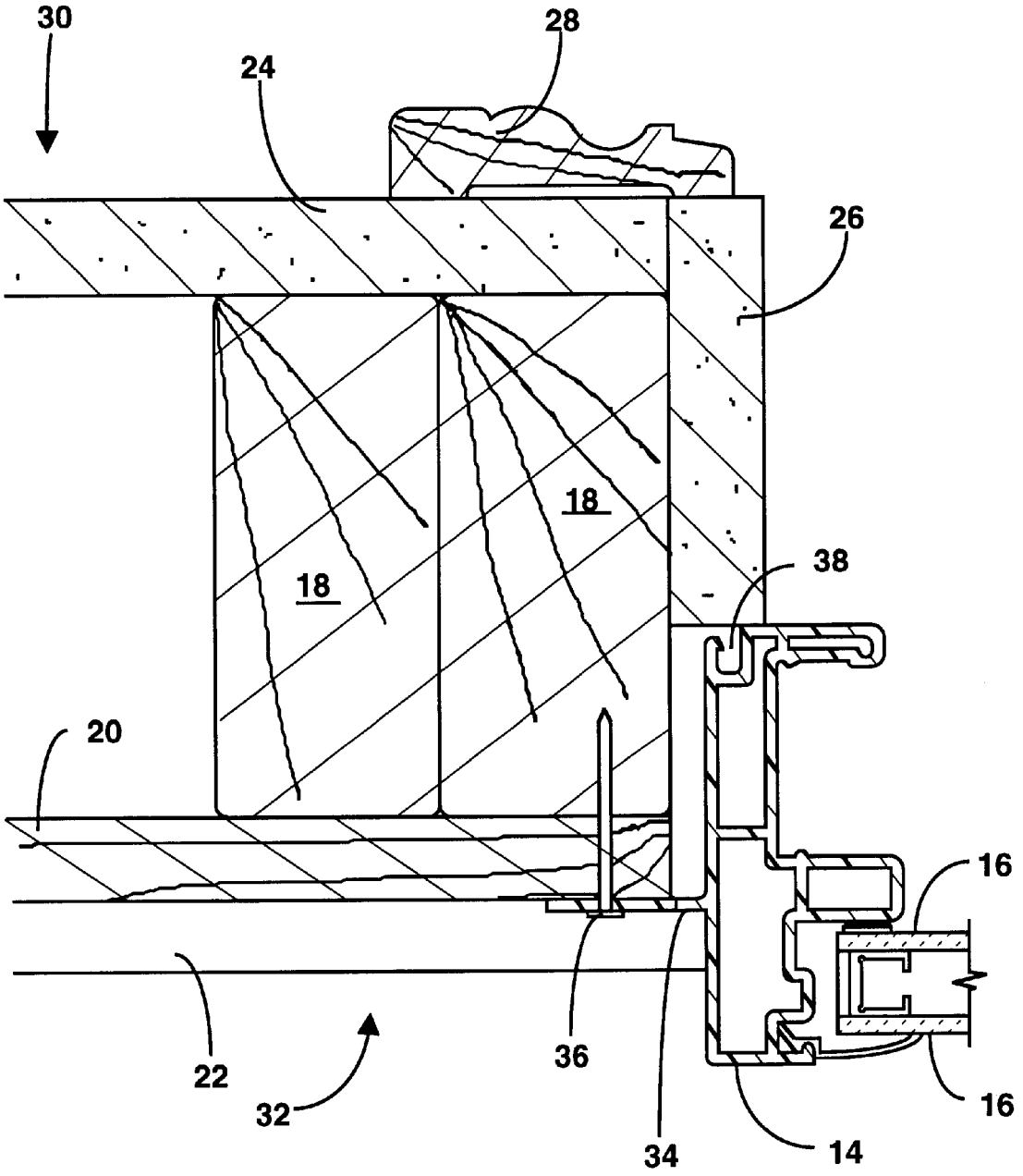
PRIOR ART FIG. 1
FIG. 1 is a cross-sectional view of a prior art window rim treatment.

FIG. 1 shows a prior art window trim. It includes a window frame 14 with window panes 16. The window frame 14 is mounted by nailing flange 34 with window frame nail 36. The window frame 14 is mounted against plywood subsiding 20, and covered by siding 22. The wall includes studs 18, sheet rock 24, interior wall surface, 30, exterior wall surface 32, jamb 26, and casing 28. Along an edge of the window frame 14 is a mulling groove 38.

Figure 2:
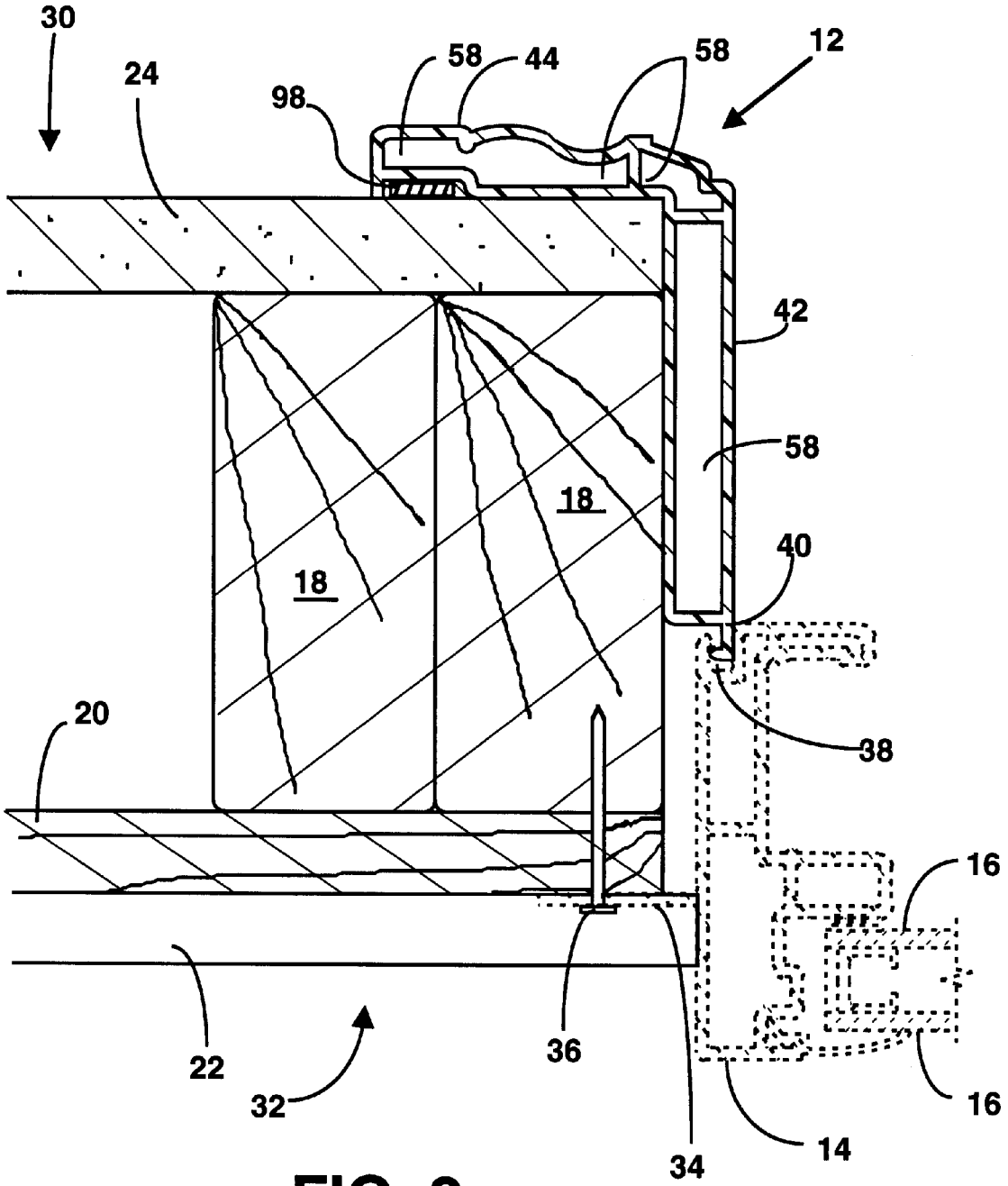
FIG. 2 is a cross-sectional view of a one-piece window trim assembly.

Referring to FIGS. 2 through 6, the invention is shown to advantage. A preferred embodiment of the invention is shown in FIG. 2 and designated 10. The invention shown includes a generally L-shaped casing piece 12, which is preferably made of extruded vinyl, though other extrudable materials can be used, including metal, vinyl mixed with wood particles, wood particles mixed with binder material, or other extrudable materials. The casing piece 12 is cut from a length of material with the casing piece cross-sectional shape shown in FIG. 2. Sections are cut from this material to form mitered casing piece sections. Mitered casing piece sections 12 are generally L-shaped in cross-section, and is made of two parts: the body portion 42 of the mitered casing piece and a flange portion 44 of the mitered casing piece. The body portion 42 attaches to the flange portion 44 at a 90° angle. The body portion 42 of the mitered casing piece 12 includes a protruding ridge 40 which engages the window frame 14 at the mulling groove 38. Body portion 42 and flange portion 44 form hollow channels 58 within the mitered casing piece sections, which have similar cross-sectional shapes as their wood trim counterparts which were the casing 28 and jamb 26 of FIG. 1.

Figure 5:
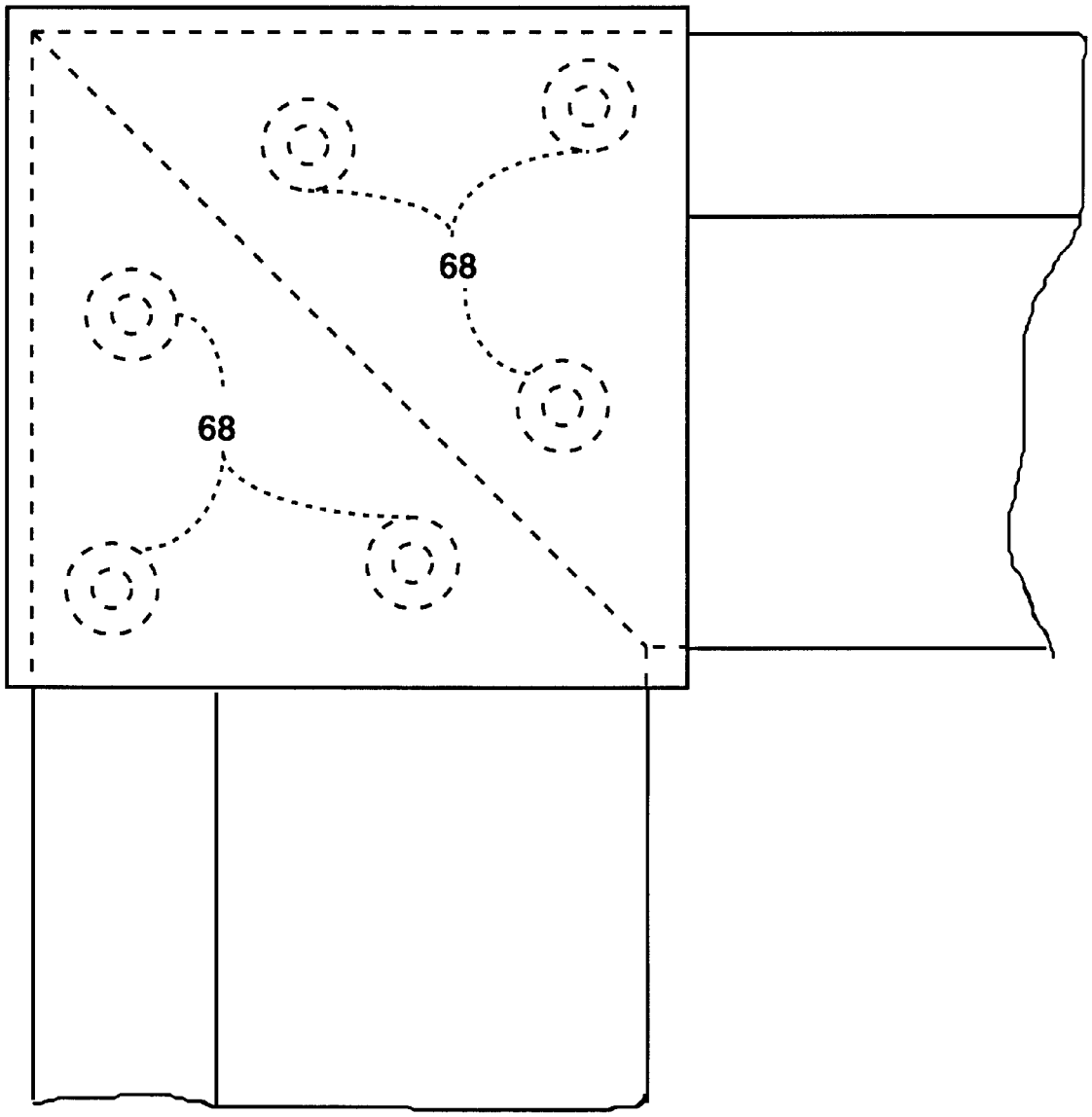
FIG. 5 is a front view of a corner piece used to join two window trim pieces.
Figure 6:
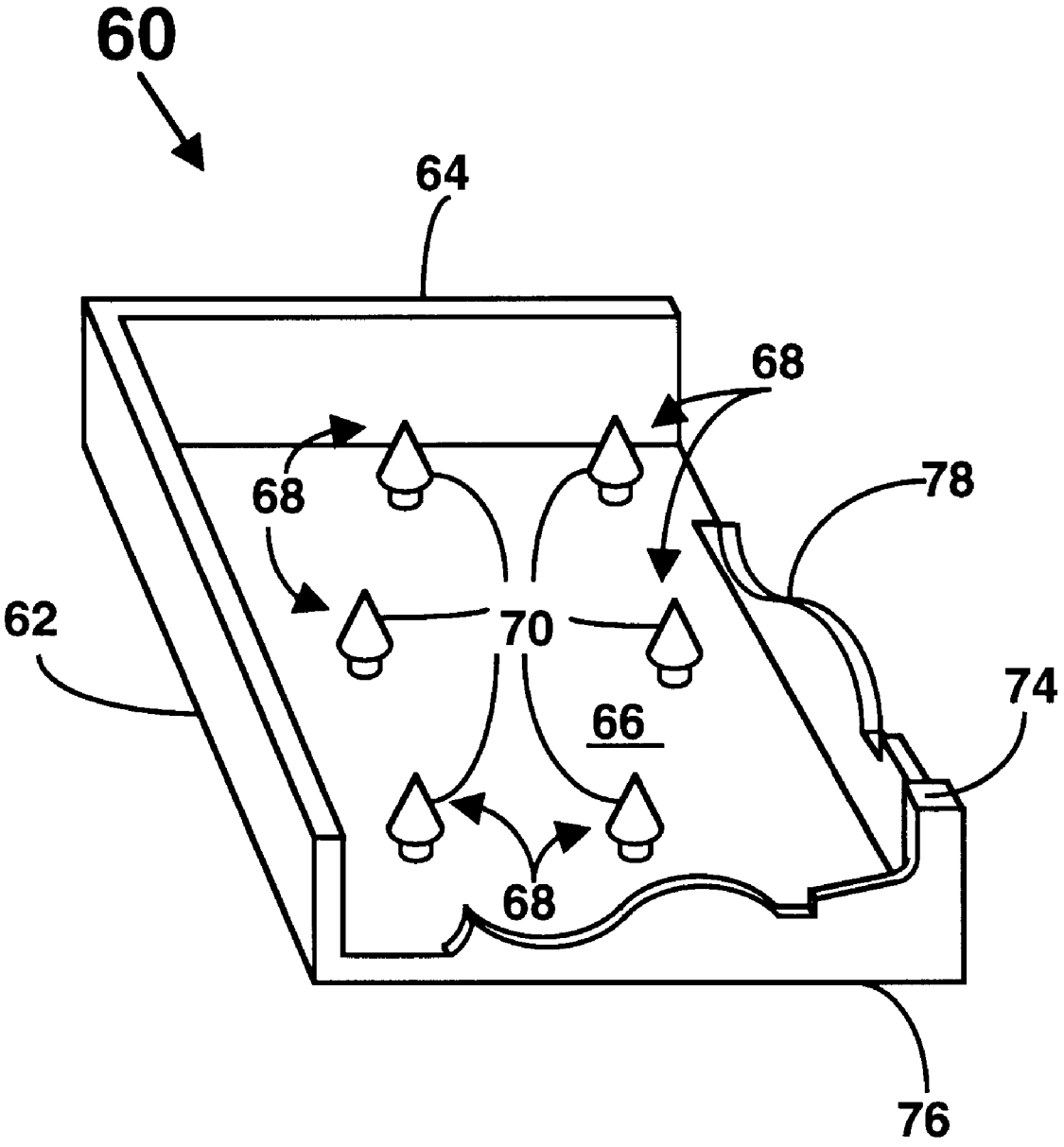
FIG. 6 is a perspective view of a corner piece used to pin two window trim pieces.

The vinyl window finish trim assembly also includes a corner piece 60, as shown in FIGS. 5 and 6. Corner piece 60 is a generally rectangular piece with adjacent side walls 62 and 64 which are perpendicular to the plane of corner piece plate 66. On plate 66 are mounted a number of engagement pins 68. Each engagement pin 68 has a tip 70. Tips 70 of engagement pins 68 go through holes drilled in the mitered casing pieces 12. Side wall 62 and 64 join at one of their corners. At a corner on the plate 66 opposite their corner of joining is plate post 74. Plate post 74 extends from plate 66 an equal height as side walls 62 and 64. The two remaining side walls 76 and 78 have profiles which match the contours of the flange portion of the mitered casing piece sections 12.

In use, the vinyl window finish trim assembly of this embodiment would be extruded in lengths of vinyl material which are of the cross section shape shown in FIG. 2. The walls of the extruded shape would be approximately 0.080 thick. The extruded shapes would be cut into mitered casing piece sections 12, appropriate to line the inside casing surfaces of a framed window opening. This cutting and subsequent assembly could take place in a factory or on site. Before the mitered casing piece sections were installed, a window frame 14 with window panes 16 mounted in it would be mounted into a window opening by the use of a nailing flange 34 and window frame nails 36. The window frame is shown as a dotted line in FIG. 2. The window frame has a window frame mulling groove 38, into which the protruding ridge 40 from the mitered casing piece sections 12 are inserted. Other means of engaging the casing piece with the window frame are also possible, such as gluing, setting in a bed of caulk, or use of adhesives. Window frames come in a variety of shapes and configurations, and each shape of window frame may have a different shaped mulling groove and would therefore require an adaption in the shape of the protruding ridge 40. After four mitered casing piece sections 12 are mounted in the mulling grooves 38 along the four edges of window frame 14, the flange portion 44 is attached to the interior wall surface by the use of an adhesive strip 98, or by an adhesive bead, or by double-sided tape, each of which securely mounts the extruded vinyl mitered casing pieces 12 into place. When installed, no nails or screws are visible.

Optionally, a corner piece 60 may be placed over the mitered corners of the vinyl window finish trim assembly. The corner pieces would provide ornamentation to the assembly, as well as provide structural reinforcement to the corners. At present, the welding of mitered corners in extruded vinyl parts leaves the possibility of an uneven seam or beads of molten plastic along the seam. The use of corner pieces may be necessary to hide the seam until better welding or joining methods are developed. To install corner pieces, holes in the mitered casing sections would be drilled, and the tips 70 of the engagement pins 68 would be snapped into place.

Figure 3:
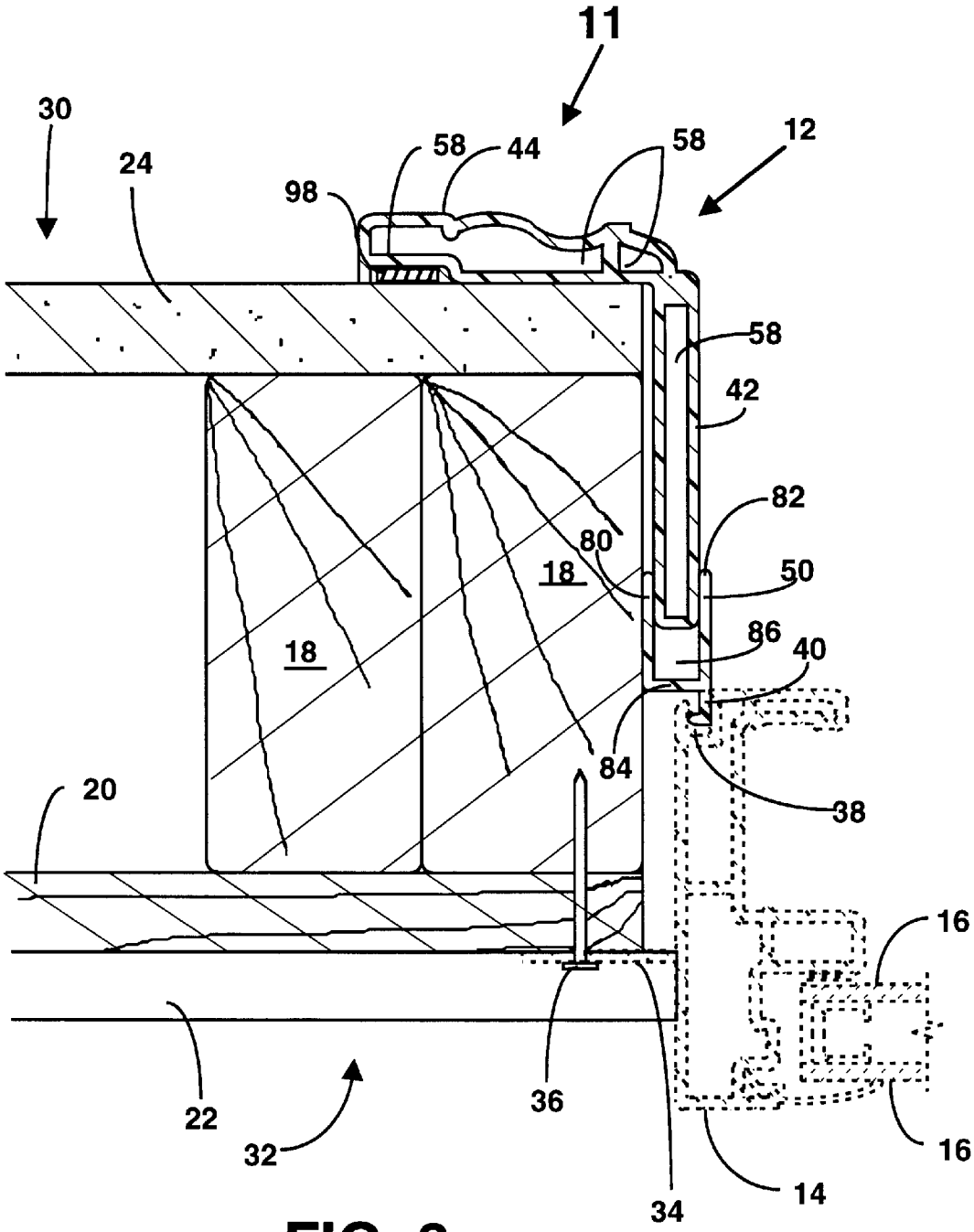
FIG. 3 is a cross-sectional view of a two-piece window trim assembly.

A second preferred embodiment of the invention is shown in FIG. 3, and designated 11. In this embodiment of the invention, a generally U-shape extruded vinyl channel piece shape is added. This channel piece shape is extruded in convenient lengths and cut into mitered channel piece sections 50 to fit the size of the window opening to be trimmed. Each mitered channel piece section 50 has a protruding ridge 40 which engages the mulling groove 38 along the edges of the window frame 14. The channel piece can also engage the window frame 14 by the use of adhesive, by bedding in caulking, or by screws, rivets, or by any other suitable mechanical means.

Each mitered channel piece section 50 has a first arm 80 and a second arm 82 which are joined by a joining piece 84, as shown in FIG. 3. The region between first arm 80 and second arm 82 is a U-shaped channel 86 into which the body portion 42 of the mitered casing piece section 12 is inserted. The body portion 42 is capable of extending into the U-groove 86 of the mitered channel piece section 50 to varying degrees, to accommodate variations in the relative sizes of the window frame 14, the stud 18, and the wall 88. When installed, no nails or screws are visible, and the assembly has the appearance of painted wood. A corner piece 60 may also be utilized with this preferred embodiment of the invention, as previously described.

Figure 4:
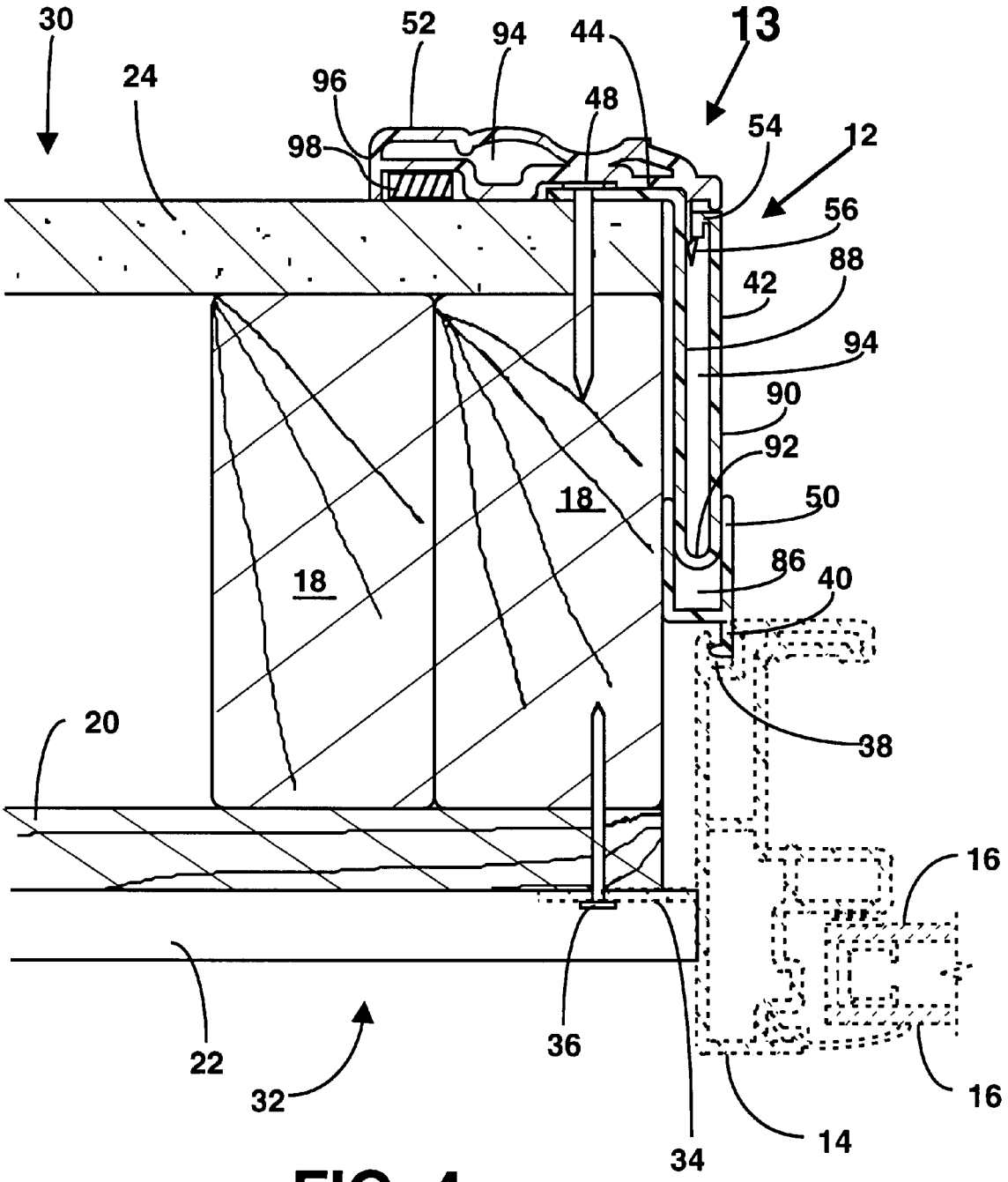
FIG. 4 is a cross-sectional view of a three-piece window trim assembly.

A third embodiment of the invention is shown in FIG. 4, and designated 13. In this embodiment of the invention, the mitered channel piece sections 50 are the same as in the second preferred embodiment, and are cut from lengths of extruded vinyl channel piece shape. After installing the window frame 14 in the window opening, four mitered channel piece sections 50 are cut to fit the inside dimensions of the window opening. As in the previous embodiment, each has a protruding ridge 40 which engages the mulling groove 38 of the window frame 14. Into the U-shaped channel 86 of each mitered channel section 50 is inserted body portion of the casing section 42. For each window, four mitered casing sections are cut from a casing piece shape to fit the inside dimensions of the window opening, as in the previous embodiments.

The mitered casing sections 12 of this embodiment are generally L-shaped and include a body section 42 and a flange section 44. The flange section 44 is attached at a right angle to the body section 42. The body section 42 has an inside wall 88 and an outside wall 90 connected by a U-shaped section 92 enclosed by the inside wall and the outside wall is a hollow region 94. At the end of the outside wall 90, furthest away from the U-shaped section and adjacent to flange portion 44, is a snap ridge 54.

This embodiment of the invention also has a mitered molding section 52, which is cut from a molding-shape piece. The mitered molding section 52 is shown in cross section in FIG. 4. The mitered molding section 52 includes a snap projection 56, a molding body 94, and a molding ridge 96.

In use, this embodiment of the invention would be assembled in a similar manner as the second embodiment as regards the mitered channel sections and the mitered casing sections. Additionally, mitered molding sections 52 would be cut to the appropriate length for the window opening, from a length of extruded molding shape. The snap projection 56 of the mitered molding section 52 would be pressed through the opening between the snap ridge 54 and the inside wall 88. This releasably locks down the mitered molding section 52 to the mitered casing sections 12. The molding ridge 96 is available for adjustment by sanding, planing, filing or grinding, or by other means, to account for irregularities in the interior wall surface 30. A corner piece 60 is optionally used, as described previously. As in the other versions, no nails or screws would be visible, and the finished assembly would have the appearance of painted wood.

While there is shown and described the present preferred embodiment of the invention, it is to be distinctly understood that this invention is not limited thereto but may be variously embodied to practice within the scope of the following claims.

I claim:

1. A vinyl window finish trim assembly which interfits with an extruded window frame in a standard framed window opening in a wall with an interior wall surface and an exterior wall surface, said window frame mounted in said window opening adjacent said exterior wall surface and said window opening having four framed sides, each framed side with an inner edge adjacent said window frame, an outer edge adjacent said interior wall surface, and a casing surface between said inner edge and said outer edge of each framed side, in which said vinyl window finish trim assembly comprises:

four generally L-shaped extruded casing piece sections, with mitered ends, which are joined together at said ends in miter joints, said casing piece sections to cover said four casing surfaces of said window opening, and which circumscribe said window opening in said wall, in which each casing piece section has a dimensional and surface appearance of painted wood window trim, and which has a body portion for engagement with said window frame and extending from said window frame to proximate said interior wall surface, and which has a flange portion extending radially from said body portion, said flange portion for covering a portion of the interior wall surface adjacent said window opening;

a means of attaching said body portion of said casing piece sections to said extruded window frame, said means of attaching said body portion of said casing piece sections to said extruded window frame is a protruding ridge on the body portion which interfits with a groove in the extruded window frame;

a means of attaching said casing piece sections to said interior wall surface; and four corner pieces for attachment to said casing piece sections adjacent said miter joints, in which said corner pieces include engagement pins which are inserted through holes in said casing piece sections, for joining and strengthening said mitered casing pieces, and to cover a seam between said mitered ends of said casing piece sections.

2. The vinyl window finish trim assembly of claim 1 in which the means of attaching the casing piece sections to the interior wall surface is by means of adhesive.

3. A vinyl window finish trim assembly which interfits with an extruded window frame with four edges in a standard framed window opening in a wall with an interior wall surface and an exterior wall surface, said window frame mounted in said window opening adjacent said exterior wall surface and said window opening having four framed sides, each framed side with an inner edge adjacent said window frame, an outer edge adjacent said interior wall surface, and a casing surface between said inner edge and said outer edge of each framed side, in which said vinyl window finish trim assembly comprises:

four generally U-shaped extruded vinyl channel piece sections, with mitered ends, which are joined together at said ends in miter joints, said channel piece sections for engaging said extruded window frame, having a dimensional and surface appearance of painted wood window trim, and for slidably interfitting relationship with a corresponding casing piece section;

a means of attaching said channel piece sections to said casing surfaces adjacent said extruded window frame;

four generally L-shaped extruded vinyl casing piece sections, with mitered ends which are joined together in casing miter joints, said casing piece sections having a slidable interfitting relationship with said channel piece sections, which are placed in and circumscribe said window opening in said wall, said casing piece sections having a dimensional and surface appearance of painted wood window trim, and the casing piece sections having a body portion slidably interfitting with said channel piece sections and extending from said channel piece sections to proximate the interior wall surface, and having a flange portion extending radially from said window opening, and attached to said body portion perpendicular to said body portion, said flange portion for covering a portion of said interior wall surface adjacent said window opening;

a means of attaching the casing piece sections to said interior wall surface; and four corner pieces for attachment to said casing piece sections adjacent said casing miter joints, said corner pieces include engagement pins which are inserted through holes in said casing piece sections, for joining and strengthening said casing piece sections, and to cover a seam between said mitered ends of said casing piece sections.

4. The vinyl window finish trim assembly of claim 3 in which the means of attaching the channel piece sections with the extruded window frame is a projecting ridge on the channel piece sections which interfits with a groove in the extruded window frame.

5. The vinyl window finish trim assembly of claim 3 in which the means of attaching the casing member sections to the interior wall surface is by means of adhesive.

6. A vinyl window finish trim assembly which interfits with an extruded window frame with four edges in a framed window opening in a wall with an interior wall surface and exterior wall surface, said window frame mounted in said window opening adjacent said exterior wall surface and said window opening having four framed sides, each framed side with an inner edge adjacent said window frame, an outer edge adjacent an interior wall surface, and a casing surface between the inner edge and outer edge of each framed side, in which said vinyl window finish trim assembly comprises:

four generally U-shaped extruded vinyl channel piece sections, with mitered ends which are joined together at said ends in miter joints, said channel piece sections to interfit with said four edges of the window frame, and which each channel piece section has a dimensional and surface appearance of painted wood window trim, and for slidable interfitting relationship with a mitered casing piece section;

a means of removably engaging said mitered channel piece sections with said extruded window frame;

four generally L-shaped extruded vinyl casing piece sections with mitered ends which are joined together at said ends in casing miter joints, to cover said four casing surfaces of said window opening and the casing piece sections are in slidable interfitting relationship with said mitered channel piece sections, and which circumscribe said opening in said wall, and which provide for interfitting relationship with a mitered molding piece section, said casing piece sections having a body portion slidably interfitting with said channel piece sections and extending from said channel piece sections to proximate said inner wall surface, and have a dimensional and surface appearance of painted wood window trim, and said casing piece sections having a flange portion extending radially around said window opening, and attached to said body portion perpendicular to said body portion, said flange portion for covering a portion of said interior wall surface adjacent said window opening, and for attachment to said interior wall surface;

a means of attaching the casing piece sections to said interior wall surface;

four molding piece sections with mitered ends which are joined together in a miter joint, for interfitting relationship to said casing piece sections, for circumscribing the window opening, for covering said flange portion of said casing piece sections and for covering a portion of said interior wall surface in a manner which makes said means of attachment of said casing piece sections not visible; and a means of removably engaging said molding piece sections with said casing piece sections.

7. The vinyl window finish trim assembly of claim 6 in which the means of removably engaging the channel piece sections with the extruded window frame is a protruding ridge on the channel piece sections which interfits with a groove in the extruded window frame.

8. The vinyl window finish trim assembly of claim 6 in which the means of attaching the casing piece sections to the interior wall surface is by means of screws or nails.

9. The vinyl window finish trim assembly of claim 6 in which the means of removably engaging the molding piece sections with the casing piece sections is by at least one projections or indentations on the mitered molding piece sections which interfit with at least one indentations or projections on the casing piece sections.

10. The vinyl window finish trim assembly of claim 6 which further comprises a cornerpiece for joining and strengthening the window finish trim assembly.

* * * * *